US006492315B1

(12) United States Patent
Cao et al.

(10) Patent No.: US 6,492,315 B1
(45) Date of Patent: Dec. 10, 2002

(54) UNIT DOSE NONAQUEOUS LIQUID SOFTENER DISPOSED IN WATER SOLUBLE CONTAINER

(75) Inventors: Hoai-Chau Cao, Ans (BE); Joseph Reul, Heusy (BE); Juliette Rousselet, Glons (BE); Alain Jacques, Blegny (BE); Alain Gourgue, Lincent (BE); Charles Schramm, Jr., Hillsborough, NJ (US); Amjad Farooq, Hillsborough, NJ (US); Jeffrey T. Epp, Mount Arlington, NJ (US); Marianne Zappone, Burlington, NJ (US); Arthur Wagner, Roselle Park, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/209,161

(22) Filed: Jul. 31, 2002

(51) Int. Cl.[7] ..... C11D 17/00

(52) U.S. Cl. ..... 510/296; 510/297; 510/327; 510/329; 510/330; 510/334; 510/391; 510/439; 510/501; 510/515

(58) Field of Search ..... 510/296, 297, 510/327, 329, 330, 334, 391, 439, 501, 515

(56) References Cited

U.S. PATENT DOCUMENTS

| | | | | | |
|---|---|---|---|---|---|
| 4,203,851 | A | * | 5/1980 | Ramachandran | 252/8.6 |
| 4,259,217 | A | * | 3/1981 | Murphy | 252/547 |
| 4,818,421 | A | * | 4/1989 | Boris et al. | 252/8.8 |
| 5,089,148 | A | * | 2/1992 | Van Blarcom et al. | 252/8.6 |
| 5,183,580 | A | * | 2/1993 | Lew et al. | 252/8.6 |
| 5,770,557 | A | * | 6/1998 | Bruhnke | 510/515 |
| 5,972,870 | A | * | 10/1999 | Anderson | 510/298 |

* cited by examiner

*Primary Examiner*—Necholus Ogden
(74) *Attorney, Agent, or Firm*—Richard E. Nanfeldt

(57) ABSTRACT

A water soluble container having disposed therein a non-aqueous liquid fabric softener composition.

7 Claims, No Drawings

UNIT DOSE NONAQUEOUS LIQUID SOFTENER DISPOSED IN WATER SOLUBLE CONTAINER

FIELD OF THE INVENTION

This invention relates to unit dose laundry compositions for softening or conditioning fabrics. More particularly, this invention relates to unit dose liquid fabric softening compositions, which is contained in a water-soluble container suitable for use in an automatic washing machine.

BACKGROUND OF THE INVENTION

Detergent compositions manufactured in the form of compacted detergent powder are known in the art. U.S. Pat. No. 5,225,100, for example, describes a tablet of compacted powder comprising an anionic detergent compound, which will adequately disperse in the wash water.

Although detergent compositions in the form of compacted granular tablets of various shapes have received much attention in the patent literature, the use of such tablets to provide a unit dose fabric softener which will soften or condition fabrics in the wash cycle without impairing detergency or otherwise compromise the cleaning benefits provided by the detergent composition is not known.

Laundry detergent compositions which further include a fabric softener to provide softening or conditioning of fabrics in the wash cycle of the laundering operation are well-known in the art and described in the patent literature. See, for example, U.S. Pat. No. 4,605,506 to Wixon; U.S. Pat. No. 4,818,421 to Boris et al. and U.S. Pat. No. 4,569, 773 to Ramachandran et al., all assigned to Colgate-Palmolive Co., and U.S. Pat. No. 4,851,138 assigned to Akzo. U.S. Pat. No. 5,972,870 to Anderson describes a multi-layered laundry tablet for washing which may include a detergent in the outer layer and a fabric softener, or water softener or fragrance in the inner layer. But, these type of multi-benefit products suffer from a common drawback, namely, there is an inherent compromise which the user necessarily makes between the cleaning and softening benefits provided by such products as compared to using a separate detergent composition solely for cleaning in the wash cycle and a separate softening composition solely for softening in the rinse cycle. In essence, the user of such detergent softener compositions does not have the ability to independently adjust the amount of detergent and softener added to the wash cycle of a machine in response to the cleaning and softening requirements of the particular wash load.

Some attempts have been made in the art to develop wash cycle active fabric softeners, typically in powder form. But, these type products are characterized by the same inconvenience inherent with the use of powered detergents, namely, problems of handling, caking in the container or wash cycle dispenser, and the need for a dosing device to deliver the desired amount of active softener material to the wash water.

The use of a unit dose fabric softening composition contained in a water soluble container such as a sachet offers numerous advantages. To be effective, the unit dose fabric softening compositions, contained in a sachet, must be able to disperse in the wash liquor in a short period of time to avoid any residue at the end of the wash cycle.

Typically, the wash cycle time can be as short as 12 minutes and as long as 90 minutes (in typical European washers) depending on the type of washer and the wash conditions. Therefore, the water-soluble sachet must be soluble in the wash liquor before the end of the cycle.

SUMMARY OF THE INVENTION

The present invention provides a unit dose fabric softening composition contained in a water soluble container for softening or conditioning fabrics in an automatic washing machine, said unit dose comprising (a) a wash soluble container; and (b) disposed in the water soluble container is a nonaqueous liquid fabric softener composition, the amount of composition being sufficient to form a unit dose capable of providing effective softening or conditioning of fabrics in said washing machine.

The term "fabric softener" is used herein for purposes of convenience to refer to materials which provide softening and/or conditioning benefits to fabrics in a home or automatic laundering machine.

The fabric softener composition of the invention is preferably comprised of one or more fabric softening agents, optionally a dispersing agent, and optionally a perfume.

In accordance with the process aspect of the invention there is provided a process for softening or conditioning laundry which comprises contacting the laundry with an effective amount of the unit dose laundry composition defined above.

DETAILED DESCRIPTION OF THE INVENTION

The present invention relates to a water soluble sachet containing a unit dose of a fabric softener composition, wherein the water soluble sachet is formed from a single layer of water soluble thermo plastic film such as a polyvinyl alcohol, wherein the inner surface of the film is in contact with the fabric softener composition and the external surface of the film does not have a water soluble glue disposed thereon.

The nonaqueous liquid fabric softener composition contained in the water soluble sachet comprises:

(a) 72% to 100%, more preferably 80% to 99.5% of at least one fabric softening agents;

(b) 0 to 12%, more preferably 0.5% to 10% of at least one dispersing agent;

(c) 0 to 8%, more preferably 0.5% to 6% of a perfume.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to softening performance so long as it meets the criteria of water immiscibility and having a pleasing odor. Naturally, of course, especially for softening compositions intended for use in the home, the perfume, as well as all other ingredients, should be cosmetically acceptable, i.e., non-toxic, hypoallergenic, etc.

A main component of the invented compositions and articles of the present invention, a softening agent which is an organic fatty softener. The organic softener can be anionic, cationic or nonionic fatty chains ($C_{10}$–$C_{22}$ preferably $C_{12}$–$C_{18}$). Anionic softeners include fatty acids soaps. Organic softeners can be nonionics such as fatty esters of glycerol, ethoxylated fatty esters, fatty alcohols, polyols polymers, higher fatty acid ester of a pentaerythritol compound, silicone oil-compound.

Other softening agents are olein esterquat such as dioleyloylethyl hydroxy ethylmonium methosulfate, olein amidoamine, synthetic esters such as glycerol oleate, pentaerythritil oleate, 2-ethyl hexyl oleate and natural esters such as copra oil, sunflower oil and soya oil.

The dispersing agent used in the instant nonaqueous liquid fabric softening composition are selected from the group consisting of glycereth cocoate, oleate PEG200, Dioleate PEG400, and ethoxylated nonionic surfactants formed from the reaction of one mole of a $C_{12-13}$ fatty alcohol and 2 to 4 moles of ethylene oxide and mixtures thereof.

The water soluble container which can be in the form of a sachet, a blow molded capsule or other blow molded shapes, an injected molded ampoule or other injection molded shapes, or rotationally molded spheres or capsules are formed from a water soluble thermoplastic resin. Water soluble plastics which may be considered for forming the container include low molecular weight and/or chemically modified polylactides; such polymers have been produced by Chronopol, Inc. and sold under the Heplon trademark. Also included in the water soluble polymer family are melt processable poly(vinyl) alcohol resins (PVA); such resins are produced by Texas Polymer Services, Inc., tradenamed Vinex, and are produced under license from Air Products and Chemicals, Inc. and Monosol film produced by Monosol LLC. Other suitable resins include poly (ethylene oxide) and cellulose derived water soluble carbohydrates. The former are produced by Union Carbide, Inc. and sold under the tradename Polyox; the latter are produced by Dow Chemical, Inc. and sold under the Methocel trademark. Typically, the cellulose derived water soluble polymers are not readily melt processable. The preferred water soluble thermoplastic resin for this application is PVA produced by Monosol LLC. Any number or combination of PVA resins can be used. The preferred grade, considering resin processability, container durability, water solubility characteristics, and commercial viability is Monosol film having a weight average molecular weight range of about 55,000 to 65,000 and a number average molecular weight range of about 27,000 to 33,000.

The sachet may be formed from poly(vinyl) alcohol film. The pelletized, pre-dried, melt processable polyvinyl alcohol (PVA) resin, is feed to a film extruder. The feed material may also contain pre-dried color concentrate which uses a PVA carrier resin. Other additives, similarly prepared, such as antioxidants, UV stabilizers, anti-blocking additives, etc. may also be added to the extruder. The resin and concentrate are melt blended in the extruder. The extruder die may consist of a circular die for producing blown film or a coat hanger die for producing cast film. Circular dies may have rotating die lips and/or mandrels to modify visual appearance and/or properties. Alternatively, the PVA resins can also be dissolved and formed into film through a solution-casting process, wherein the PVA resin or resins are dissolved and mixed in an aqueous solution along with additives. This solution is cast through a coat hanger die, or in front of a doctor blade or through a casting box to produce a layer of solution of consistent thickness. This layer of solution is cast or coated onto a drum or casting band or appropriate substrate to convey it through an oven or series of ovens to reduce the moisture content to an appropriate level. The extruded or cast film is slit to the appropriate width and wound on cores. Each core holds one reel of film.

Typical film properties are:

1. Tensile strength (125 ml, break, 50% RH)=4,700 to 5,700 psi
2. Tensile modulus (125 mil, 50% RH)=47,000 to 243,000 psi; preferred range is 140,000 to 150,000 psi
3. Tear resistance (mean) (ASTM-D-199gm/ml)=900–1500
4. Impact strength (mean) (ASTM-D-1709, gm)=600–1,000
5. 100% Elongation (mean) (ASTM-D-882, psi)=300–600
6. Oygen transmission (1.5 mil, 0% RH, 1 atm)=0.0350 to 0.450 cc/100 sq. in./24 h
7. Oxygen transmission (1.5 mil, 50% RH, 1 atm)=1.20 to 1.50 cc/100 sq. in./24 h
8. 100% modulus (mean) (ASTM-D-882, psi)=1000–3000
9. Solubility (sec) (MSTM-205,75° F) disintegration=1–15; dissolution=10–30

Typical resin properties are:

1. Glass Transition Temperature (° C)=28 to 38; preferred is 28 to 33,
2. Weight Average Molecular Weight (Mw)=15,000 to 95,000; preferred is 55,000–65,000
3. Number Average Molecular Weight (Mn)=7,500 to 60,000; preferred is 27,000 to 33,000. Preferred poly (vinyl) alcohol film is formed from Monosol 7030 or Monosol 8630

Reels of slit film are fed to a form, fill, seal machine (FFS). The Form, Fill, Seal machine (FFS) makes the appropriate sachet shape (cylinder, square, pillow, oval, etc.) from the film , fills the sachet with product, and seals the sachet.

There are many types of form fill seal machines that can convert water soluble films, including vertical, horizontal and rotary machines. To make the appropriate sachet shape, one or multiple films can be used. The sachet shape can be folded into the film, mechanically deformed into the film, or thermally deformed into the film. The sachet forming can also utilize thermal bonding of multiple layers of film, or solvent bonding of multiple layers of film. When using poly(vinyl) alcohol the most common solvent is water. Once the appropriately shaped sachet is filled with product, the sachet can be sealed using either thermal bonding of the film, or solvent bonding of the film.

Blow molded capsules are formed from the poly(vinyl) alcohol resin having a molecular weight of about 50,000 to about 70,000 and a glass transition temperature of about 28 to 33° C. Pelletized resin and concentrate(s) are feed into an extruder. The extruder into which they are fed has a circular, oval, square or rectangular die and an appropriate mandrel. The molten polymer mass exits the die and assumes the shape of the die/mandrel combination.. Air is blown into the interior volume of the extrudate (parison) while the extrudate contacts a pair of split molds. The molds control the final shape of the package. While in the mold, the package is filled with the appropriate volume of liquid. The mold quenches the plastic. The liquid is contained within the interior volume of the blow molded package.

An injection molded ampoule or capsule is formed from the poly(vinyl) alcohol resin having a molecular weight of about 50,000 to about 70,000 and a glass transition temperature of about 28 to 38° C. Pelletized resin and concentrate(s) are fed to the throat of an reciprocating screw, injection molding machine. The rotation of the screw pushes the pelletized mass forward while the increasing diameter of the screw compresses the pellets and forces them to contact the machine's heated barrel. The combination of heat, conducted to the pellets by the barrel and frictional heat, generated by the contact of the pellets with the rotating screw, melts the pellets as they are pushed forward. The molten polymer mass collects in front of the screw as the screw rotates and begins to retract to the rear of the machine. At the appropriate time, the screw moves forward forcing the melt through the nozzle at the tip of the machine and into a mold or hot runner system which feeds several molds. The molds control the shape of the finished package. The package may be filled with liquid either while in the mold or after ejection from the mold. The filling port of the package is heat sealed after filling is completed. This process may be conducted either in-line or off-line.

A rotationally molded sphere or capsule is formed from the poly(vinyl) alcohol resin having a molecular weight of about 50,000 to about 70,000 and a glass transition temperature of about 28 to 38° C. Pelletized resin and concentrate are pulverized to an appropriate mesh size, typically 35 mesh. A specific weight of the pulverized resin is fed to a cold mold having the desired shape and volume. The mold is sealed and heated while simultaneously rotating in three directions. The powder melts and coats the entire inside surface of the mold. While continuously rotating, the mold is cooled so that the resin solidifies into a shape which replicates the size and texture of the mold. After rejection of the finished package, the liquid is injected into the hollow package using a heated needle or probe after filling, the injection port of the package is heat sealed.

Typical unit dose compositions for use herein may vary from about 5 to about 20 ml corresponding on a weight basis to about 5 to about 20 grams (which includes the weight of the capsule).

The following examples illustrate liquid fabric softening compositions of the described invention. Unless otherwise specified, the proportions in the film and elsewhere in the specification are by weight.

EXAMPLE 1

The following fabric softener to be used in the wash cycle was prepared comprising the following ingredients

| Ingredients | % (nominal) |
|---|---|
| PDMS(*) | 19.00 |
| Trioleate Glycerol | 15.00 |
| Sunflower Oil | 60.70 |
| Perfume | 5.30 |

(*)Polydimethylsiloxane

The above formula was filed by the previously described method into a polyvinyl alcohol sachet having a film thickness of about 0.25 to 5 mils, more preferably 1 to 3 mils.

The sachets containing the above formulas were dissolved in one to two minutes during the wash cycle.

The softness provided by the unit dose composition was evaluated on cotton tee-shirts and towels in European washing machine and compared with commercial liquid fabric softener. The unit dose composition provided essentially equivalent softness

EXAMPLE 2

The following fabric softener composition formulas to be used in the rinse cycle were prepared in wt. % by simple mixing:

| | 1 | 2 | 3 |
|---|---|---|---|
| Olein esterquat | 56.6 | 56.6 | 56.6 |
| Radia 7171 (1) | 25.0 | — | — |
| Radia 7363 (2) | — | 25.0 | — |
| Radia 7331 (3) | — | — | 25.0 |
| NI 3EO (4) | 7.0 | 7.0 | 7.0 |
| Isopropanol | 6.3 | 6.3 | 6.3 |
| Perfume | 5.1 | 5.1 | 5.1 |
| Aspect | clear light yellow liquid | clear light yellow liquid | clear light yellow liquid |
| Viscosity (cps) | 264 | 230 | 177 |

(1) Pentaerythritol Tetraoleate (ex Fina)
(2) Glycerol Trioleate (ex Fina)
(3) 2-Ethylhexyl Oleate (ex Fina)
(4) C12–13 fatty alcohol EO 3:1

The above formulas were filed at a dosage of 8.0 ml by the previously described method into a polyvinyl alcohol sachet having a film thickness of about 0.25 to 5 mils, more preferably 1 to 3 mils.

The above three were evaluated in real life European washing machine at the dosage 8.0 ml against 110 ml current French regular Soupline.

Test Conditions

Miele W 832 washing machine, heavy duty cycles 300 ppm hardness tap water 150 gr HDD detergent for wash cycle 110.0 ml Soupline for rinse cycle 8.0 ml nonaqueous Prototype for rinse cycle Softening evaluations by pair comparison by 4 judges Softening Results

| Product | Score | Statistic conclusion |
|---|---|---|
| Soupline | 0.250 | Proto2 = Proto3 = Soupline = Proto1 |
| Prototype 1 | 0.469 | |
| Prototype 2 | −0.500 | |
| Prototype 3 | −0.219 | |

Using at 8.0 ml, prototype one can deliver slightly better softening than Soupline at 110 ml, however at 95% confidence they are all equivalent. The concentrate clear FS prototypes, containing only liquid ingredients, can thus deliver fourteenfold-softening performance compared to Soupline.

EXAMPLE 3

The following fabric softener composition formulas to be used in the rinse cycle were prepared in wt. % by simple mixing:

| | 1 | 2 | 3 |
|---|---|---|---|
| Olein esterquat | 19.0 | 19.0 | 19.0 |
| Sunflower oil | 48.6 | 48.6 | 48.6 |
| Radia 7363 (1) | 20.0 | 20.0 | 20.0 |
| Levenol C315 (2) | 5.0 | | |
| Radiasurf 7443 (3) | — | 5.0 | — |
| Radiasurf 7402 (4) | — | — | 5.0 |
| Isopropanol | 2.1 | 2.1 | 2.1 |
| Perfume | 5.3 | 5.3 | 5.3 |
| Aspect | clear light yellow liquid | clear light yellow liquid | clear light yellow liquid |
| Viscosity (cps) | 100 | 94 | 104 |

(1) Glycerol Trioleate (ex Fina)
(2) Glycerol-1 Cocoate (ex Fina)
(3) Dioleate PEG400 (ex Fina)
(4) Mono-oleate PEG200 (ex Fina)

The above formulas were filed at a dosage of 8.0 g by the previously described method into a polyvinyl alcohol sachet having a film thickness of about 0.25 to 5 mils, more preferably 1 to 3 mils

What is claimed is:

1. A softening system which comprises:

(a) a water soluble container which is formed from a polyvinyl alcohol;

(b) a liquid fabric softener composition disposed in said water soluble container, wherein said fabric softener composition comprises 72% to 100% of a dioleyloyl-ethyl hydroxyethylmonium methosulfate softening agent;

(C) a second softening agent; and (D) 0.5 wt % to 10 wt % of at least one dispersing aid.

2. The system according to claim 1 wherein said container is a sachet, ampoule, capsule or sphere.

3. The system according to claim 1 further containing a second softening agent which is selected from the group consisting of olein amido-amine, synthetic esters and natural esters and mixtures thereof.

4. The system according to claim 3 wherein said synthetic ester is selected from the group consisting of glycerol oleate, pentaerythritol oleate and 2-ethyl hexyloleate and mixtures thereof.

5. The system according to claim 3 wherein said natural ester is selected from the group consisting of soya oil, copra oil and sunflower oil and mixtures thereof.

6. The system according to claim 1 wherein at least one said dispersing agent is selected from the group consisting of glycereth cocoate, oleate PEG200, dioleate PEG400 and a $C_{12}$–$C_{13}$ EO3:1 ethoxylated fatty alcohol and mixtures thereof.

7. The system according to claim 1 further including 0.5 wt. % to 6 wt. % of a perfume.

* * * * *